US006194841B1

(12) United States Patent
Takahashi et al.

(10) Patent No.: US 6,194,841 B1
(45) Date of Patent: Feb. 27, 2001

(54) DISCHARGE LAMP LIGHTING DEVICE

(75) Inventors: Osamu Takahashi; Kazuhiko Tsugita; Isamu Ogawa; Tetuya Kobayashi; Isao Masatika; Tadashi Maeda; Koji Shibata; Kenji Hamazaki; Hiroaki Nishikawa, all of Kanagawa (JP)

(73) Assignees: Mitsubishi Denki Kabushiki Kaisha, Tokyo; Mitsubishi Electric Lighting Corporation, Kamakura, both of (JP)

( * ) Notice: Subject to any disclaimer, the term of this patent is extended or adjusted under 35 U.S.C. 154(b) by 0 days.

(21) Appl. No.: 09/334,768

(22) Filed: Jun. 16, 1999

(30) Foreign Application Priority Data

Jul. 14, 1998 (JP) ..... 10-198849

(51) Int. Cl.[7] ..... H05B 37/02

(52) U.S. Cl. ..... 315/224; 315/307; 315/360; 315/DIG. 4

(58) Field of Search ..... 315/224, 209 R, 315/291, 307, 360, DIG. 4, DIG. 5, DIG. 7

(56) References Cited

U.S. PATENT DOCUMENTS 4,647,817 * 3/1987 Fahnrich et al. ..... 315/DIG. 7
5,048,033 * 9/1991 Donahue et al. ..... 315/307
5,828,187 * 10/1998 Fischer ..... 315/291
6,023,132 * 2/2000 Crouse et al. ..... 315/224

OTHER PUBLICATIONS

"CFL/TL Ballast Driver Preheat and Dimming," STMicroelectronics, L6574, (May 1998), pp. 1–9.
I. D. Santo, et al., "Electronic Ballast With PFC Using L6574 and L6561," SGS–Thomson Microelectronics, AN993, (Feb. 1998), pp. 1–9.
Drawing showing, "Lamp Current Controlled System," L6574.

* cited by examiner

*Primary Examiner*—Don Wong
*Assistant Examiner*—Thuy Vinh Tran
(74) *Attorney, Agent, or Firm*—Oblon, Spivak, McClelland, Maier & Neustadt, P.C.

(57) ABSTRACT

A discharge lamp lighting device in which dim control can be performed for a discharge lamp continuously and stably in a wide range, and which is simple in circuit configuration and low in price. The discharge lamp lighting device comprises: an inverter (IV) for turning on/off switching elements (Q2, Q3) by an oscillation output signal of an IV control integrated circuit (IC2) to thereby invert a voltage of a DC power supply (E) into high-frequency electric power, a discharge lamp (LA) capable of being lighted by the high-frequency electric power from the inverter (IV), a feedback circuit (FB) having delay time T (unit: second) expressed by $1/f \leqq T \leqq 1/10{,}000$ when the frequency of the high-frequency electric power is f, the feedback circuit (FB) including a reference value setting means (R15) for setting a reference value, the feedback circuit outputting a voltage for controlling the IV control integrated circuit (IC2) to make the high-frequency electric power equal to the reference value.

5 Claims, 14 Drawing Sheets

(a) REFERENCE VOLTAGE (VR) OF IC3 IS HIGH. (BRIGHT)

(b) REFERENCE VOLTAGE (VR) OF IC3 IS MEDIUM. (MIDDLE)

(c) REFERENCE VOLTAGE (VR) OF IC3 IS LOW. (DARK)

(a) REFERENCE VOLTAGE (VR) OF IC3 IS HIGH. (BRIGHT)

(b) REFERENCE VOLTAGE (VR) OF IC3 IS MEDIUM. (MIDDLE)

(c) REFERENCE VOLTAGE (VR) OF IC3 IS LOW. (DARK)

(a) REFERENCE VOLTAGE (VR) OF IC3 IS HIGH. (BRIGHT)

(b) REFERENCE VOLTAGE (VR) OF IC3 IS MEDIUM. (MIDDLE)

(c) REFERENCE VOLTAGE (VR) OF IC3 IS LOW. (DARK)

(a) REFERENCE VOLTAGE (VR) OF IC3 IS HIGH. (BRIGHT)

(b) REFERENCE VOLTAGE (VR) OF IC3 IS MEDIUM. (MIDDLE)

(c) REFERENCE VOLTAGE (VR) OF IC3 IS LOW. (DARK)

(a) REFERENCE VOLTAGE (VR) OF IC3 IS HIGH. (BRIGHT)

(b) REFERENCE VOLTAGE (VR) OF IC3 IS MEDIUM. (MIDDLE)

(c) REFERENCE VOLTAGE (VR) OF IC3 IS LOW. (DARK)

DISCHARGE LAMP LIGHTING DEVICE

BACKGROUND OF THE INVENTION

1. Technical Field

The present invention relates to a discharge lamp lighting device for lighting a discharge lamp by high-frequency power generated by an inverter, and particularly to a discharge lamp lighting device having a simple configuration for performing dim control for a discharge lamp stably.

2. Background Art

Here, inspection will be made upon a conventional discharge lamp lighting device. FIG. 12 is a circuit diagram of a conventional discharge lamp lighting device, and FIG. 13 is a high-frequency voltage waveform diagram. In FIG. 12, the reference symbol E designates a DC power supply; IV, an inverter for inverting a DC voltage into a high-frequency voltage; LA, a discharge lamp having preheating electrodes F1 and F2; T, a ballast choke for limiting a discharge lamp current of the discharge lamp LA; C5, a coupling capacitor connected between the ballast choke T and the preheating electrode F2; C6, a starting capacitor connected between both the terminals of the discharge lamp LA; and FB, a feedback circuit for controlling the oscillation frequency so as to keep the output in a set value.

Next, the circuit configuration of the inverter IV will be described. Q2 and Q3 designate MOS FETs which are switching elements. In the MOS FET Q2, the drain is connected to the DC power supply, the source is connected to the drain of the MOS FET Q3, and the gate is connected to a pin 2 of an IV control integrated circuit IC2 which will be described later. In the MOS FET Q3, the source is connected to the DC power supply E through a detection resistor R6, and the gate is connected to a pin 4 of the IV control integrated circuit IC2.

The reference symbol R1 designates a starting resistor connected to the DC power supply E; C3, a control power capacitor connected between the starting resistor R1 and the earth; DZ, a voltage regulating diode for stabilizing the voltage of the control capacitor C3; IC2, an IV control integrated circuit for controlling the inverter IV. In the IV control integrated circuit IC2, the reference numeral 1 designates a power supply input terminal connected to a junction point between the control power capacitor C3 and the starting resistor R1; 2 and 4, voltage output terminals from which driving voltages for the MOS FET Q2 and Q3 are outputted; 3, a reference voltage output terminal; 6, a current output terminal (main oscillation resistor connection terminal) from which a current for determining resonance frequency is outputted; and 7, a current input/output terminal for charging/discharging a capacitor C4.

The description will be made below about the configuration of the feedback circuit FB. The feedback circuit FB is constituted by: resistors R2 and R3 for determining a current flowing out of the voltage output terminal 6; a capacitor C4 connected to the current input/output terminal 7; the source resistor or detection resistor R6 for detecting a high-frequency voltage flowing into the discharge lamp LA; an integrating circuit IN constituted by a resistor R5 and a capacitor C8 for averaging the high-frequency voltage detected by the detection resistor R6; and an error amplifier EA. The error amplifier EA is constituted by an operational amplifier IC3 and voltage dividing resistors R9 and R10 which are connected in series between the negative electrode of the power supply E and the junction point between the resistor R1 and the capacitor C3. The operational amplifier circuit IC3 is arranged such that the non-inverted input terminal thereof is connected to a reference voltage from the junction point between the resistors R9 and R10, while the inverted input terminal thereof is connected to a series connection of a capacitor 2, a diode D5 and the resistor R3 connected to the current output terminal 6 of the IV control integrated circuit IC2, thereby making the output voltage of the integrating circuit IN equal to the reference voltage.

Next, description will be made about the operation of the conventional discharge lamp lighting device with reference to FIGS. 12 and 13. FIG. 13 is a waveform diagram of a high-frequency voltage flowing into the discharge lamp LA when the discharge lamp is lighted.

First, the operation of the inverter circuit IV will be described. When the DC power supply E is turned on, a driving current flows in a closed loop of the power supply E the starting resistor R1, the control power capacitor C3, and to the power supply E, so that the control power capacitor C3 is charged. The voltage of the control power capacitor C3 is applied to the pin 1 of the IV control integrated circuit IC2. When the voltage of the control power capacitor C3 increases and reaches the working voltage of the IV control integrated circuit IC2, the IV control integrated circuit IC2 begins oscillation. With this oscillation, a high-frequency voltage is applied to the gate of the MOS FET Q2 of the half-bridge inverter circuit IV from the pin 2 of the IV control integrated circuit IC2, so that the MOS FET Q2 is turned ON. In addition, a low-frequency voltage is applied to the MOS FET Q3 from the pin 4 of the IV control integrated circuit IC2. Accordingly, the MOS FET Q2 and the MOS FET Q3 perform on-off operation alternately, so that the inverter circuit IV oscillates with a high frequency.

Consequently, a current flows alternately, in a closed loop, from the power supply E, to the preheating electrode F1, to the starting capacitor C6, to the preheating electrode F2, to the coupling capacitor C5, to the ballast choke T, to the MOS FET Q3, to the detection resistor R6, to the power supply E when the MOS FET Q3 is on, while, in the closed loop, from the coupling capacitor C5, to the preheating electrode F2, to the starting capacitor C6, to the preheating electrode F1, to the MOS FET Q2, to the ballast choke T, and to the coupling capacitor C5 when the MOS FET Q2 is on, so that a high-frequency current flows in a series circuit of the ballast choke T, the coupling capacitor C5, the preheating electrode F2, the starting capacitor C6, and the preheating electrode F1.

At this time, there is a relation that the capacitance value of the coupling capacitor C5 is sufficiently larger than the capacitance value of the starting capacitor C6. Accordingly, a high-frequency high voltage is generated in the starting capacitor C6 by the LC series resonance of the ballast choke T and the starting capacitor C6. This high-frequency high voltage is applied to the discharge lamp LA, so that the discharge lamp LA is lighted.

On the other hand, at this time, the high-frequency voltage generated in the detection resistor R6 is averaged by the integrating circuit IN of the feedback circuit FB, and this DC voltage is inputted into the inverted input terminal of the operational amplifier IC3 of the error amplifier EA. Then, the oscillation frequency of the IV control integrated circuit IC2 is determined by the capacitance value of the capacitor C4 and the value of a current flowing out to the resistors R2 and R3 from the current output terminal 6 of the IV control integrated circuit IC2. The larger this current value is, the higher the oscillation frequency becomes.

The current flowing into the resistor R3 from the current output terminal 6 changes in accordance with a change of the output voltage of the operational amplifier IC3, so that the oscillation frequency of the IV control integrated circuit IC2 is controlled.

Therefore, the oscillation frequency of the IV control integrated circuit IC2 is controlled by controlling the output voltage of the operational amplifier IC3 so that the output voltage of the integrating circuit IN is made equal to the reference voltage of the non-inverted input terminal of the operational amplifier IC3. As a result, the average value of the high-frequency current flowing in the detection resistor R6, that is, the load power which is the sum of power consumed by the preheating electrodes F1 and F2 of the discharge lamp LA is kept constant.

Main delay elements of the feedback circuit FB are the resistor R5 and the capacitor C8 of the integrating circuit IN, and the capacitor C2 of the error amplifier EA. The standard value of the delay time T due to those delay elements is expressed by T=(the resistance value of R5)×(the capacitance value of the capacitor C8+the capacitance value of the capacitor C2). If this expression is applied to a conventional application example as shown in FIG. 12 in which the circuit constants are such that the resistor R5 is 9.1 k Ω, the capacitor C8 is 100 nF, the capacitor C2 is 1.22 nF, and the delay time T is expressed by T=9.1 k Ω×(100 nF+1.22 nF)≈900 μs.

This delay time has been generally used taking such a case that excessive power is consumed by emission-less lighting of the discharge lamp, or the like, into consideration.

In the conventional discharge lamp lighting device, the feedback circuit FB keeps the load power in a constant value set by the reference voltage of the operational amplifier IC3, as described above. To change the load power, that is, to perform dim control for the discharge lamp LA, for example, such a method that the reference voltage of the operational amplifier IC3 is changed by changing the resistance value of the resistor R10 can be considered.

FIG. 14 is a graph showing a change of brightness X of the discharge lamp LA which is a fluorescent lamp, when the reference voltage $V_R$ of the operational amplifier IC3 is changed by changing the resistance value of the resistor R10 . In FIG. 14, the solid line designates the characteristic of a conventional example (the arrow shows a direction of the change of the reference voltage $V_R$). In the conventional example, as the reference voltage $V_R$ of the operational amplifier IC3 gets lower, the frequency f becomes higher, and the brightness X of the discharge lamp LA gets darker. However, a jump phenomenon in which the brightness X of the discharge lamp LA changes discontinuously appears when the reference voltage $V_R$ takes a value $V_{R1}$ or $V_{R2}$. That is, when dim control is performed for a fluorescent lamp continuously in the conventional example, there arises a jump phenomenon in which the lamp gets dark suddenly at the point $V_{R1}$ in the operation process to make the bright lamp dark, and the lamp gets bright suddenly at the point $V_{R2}$ in the operation process to make the dark lamp bright. Therefore, there is a problem that such a jump phenomenon gives an unpleasant feeling, and particularly it appears conspicuously when the discharge lamp LA is a fluorescent lamp and the ambient temperature of the lamp is low.

On the other hand, the dotted line designates a desirable characteristic with no jump phenomenon. In addition, a change similar to that in the case where the feedback circuit FB is not operated is observed in FIG. 12 when the delay time is 900 μs.

FIG. 15 is a graph showing a change, in enlargement, of electric characteristics with the passage of time in the fluorescent lamp LA at the reference voltage $V_{R1}$ in FIG. 14, when the function of the feedback circuit FB is not actuated. In FIG. 15, AT designates a lamp current; VT, a voltage; and WT, electric power. The solid line shows the case of the conventional example, and the dotted line shows the case of an embodiment of the present invention, which will be described later and in which no jump phenomenon appears.

When the lamp current AT is reduced gradually so as to reduce the brightness of the fluorescent lamp, the lamp current AT begins to decrease suddenly at a point a so as to drop sharply to a point b. With this fact, the lamp power WT expressed by AT×VT×(power-factor) (substantially constant) is reduced suddenly in the same manner as the lamp current AT because the lamp voltage VT changes slowly. This change of the electric characteristics with the passage of time from the point a to the point b is about 1,000 μs.

A change similar to that in the case where the feedback circuit FB is not operated is seen in FIG. 15 if the delay time is 900 μs.

As has been described above, a jump phenomenon in which brightness of a fluorescent lamp changes suddenly is caused by a sudden change of the electric current or the electric power of the fluorescent lamp.

On the other hand, the delay time of the feedback circuit FB for keeping the load power constant in the above-mentioned conventional example is about 900 μs. The value is close to the temporal change (1,000 μs) of the electric characteristics at the jump time of the fluorescent lamp.

It is therefore difficult for the feedback circuit FB to effect the function to keep load power constant against a change of the load power, at the beginning of the jump time of the fluorescent lamp, which is an input of the feedback circuit FB. In addition, if the fluorescent lamp makes a jump once, the characteristic of the fluorescent lamp largely changes, so that, within a control range of the feedback circuit FB, the feedback circuit FB can not restore the characteristic to its original state before the jump.

The present invention has been achieved to solve the foregoing problems. It is therefore an object of the present invention to provide a discharge lamp lighting device in which dim control can be performed for a discharge lamp continuously and stably in a wide range, and which is simple in circuit configuration and low in price.

SUMMARY OF THE INVENTION

In order to achieve the above object, according to an aspect of the present invention, provided is a discharge lamp lighting device comprising: an inverter for turning on/off switching elements by an oscillation output signal of an inverter control integrated circuit to thereby invert a voltage of a DC power supply into high-frequency electric power; a discharge lamp capable of being lighted by the high-frequency electric power from the inverter; a feedback circuit having delay time T (unit: second) expressed by $1/f \leqq T \leqq 1/2{,}000$, preferably $1/f \leqq T \leqq 1/10{,}000$, when the frequency of the high-frequency electric power is f, the feedback circuit including a reference value setting means for setting a reference value, the feedback circuit outputting a voltage for controlling the inverter control integrated circuit to make the high-frequency electric power equal to the reference value; the reference value setting means being designed to be able to change the reference value to thereby perform dim control on the discharge lamp. With this configuration, the discharge lamp can be subjected to dim control continuously and stably over a wide range with a simple circuit.

In the above configuration, preferably, the discharge lamp lighting device further comprises a feedback control circuit connected to an output portion of an integrating circuit provided in the feedback circuit, the feedback control circuit being driven by an electric current fed from a main oscillation resistor connection terminal determining the oscillation frequency of the inverter control integrated circuit so that the feedback control circuit makes the feedback circuit inoperative for a predetermined time required for lighting the discharge lamp since the DC power supply is turned on. With this configuration, the discharge lamp can be lighted surely.

In the above configuration, preferably, the feedback control circuit is a mask circuit which includes: a timer constituted by a capacitor and a resistor for outputting an inputted electric current for a predetermined time; and a transistor driven by the electric current fed from the timer for short-circuiting the output of the integrating circuit for a predetermined time. With this configuration, the discharge lamp can be lighted surely.

Further, in the above configuration, preferably, the feedback control circuit is a mirror integrating circuit which includes: a timer constituted by a capacitor and a resistor for outputting an inputted electric current for a predetermined time; a first transistor driven by the electric current fed from the timer; and a second transistor driven in response to driving of the first transistor for short-circuiting the output of the integrating circuit for a predetermined time. With this configuration, the discharge lamp can be lighted surely.

DETAILED DESCRIPTION OF THE PREFERRED EMBODIMENTS

Embodiment 1

In this embodiment, feedback circuit constants are established to obtain delay time so that no jump phenomenon appears.

Figure 12:
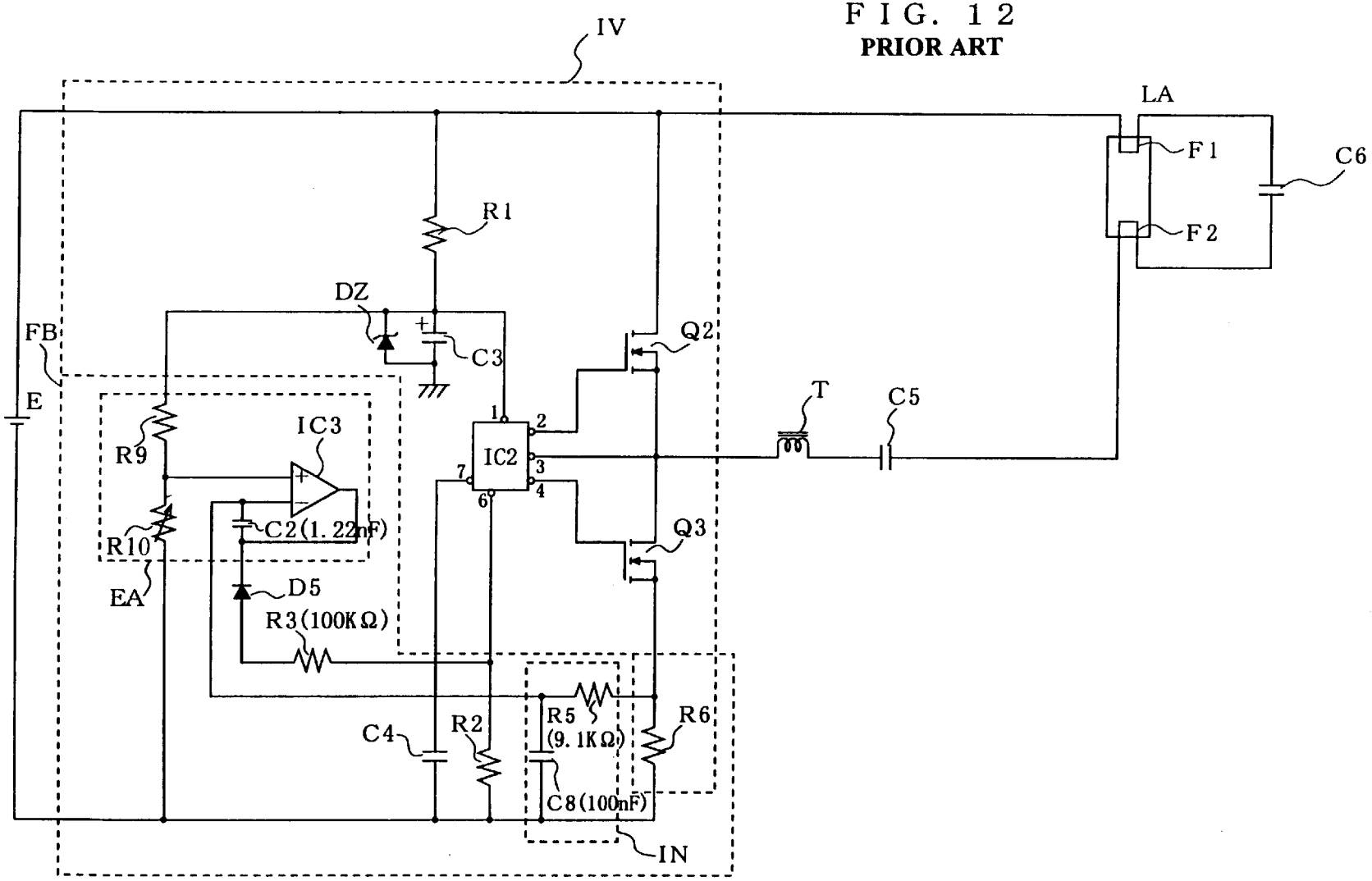
FIG. 12 PRIOR ART
FIG. 12 is a circuit diagram of a conventional discharge lamp lighting device.
Figure 13:
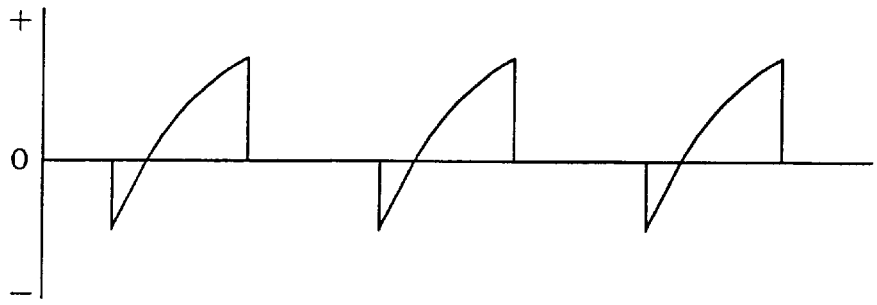
FIG. 13 PRIOR ART
FIG. 13 is a high-frequency voltage waveform diagram of the conventional discharge lamp lighting device.

In FIG. 12 showing a conventional example, the delay time T of the feedback circuit FB was determined by the resistor R5, the capacitor C8 and the capacitor C2. Accordingly, experiments were conducted under the condition that those constants were changed so that the delay time T was variously set so as to make the delay time T a parameter. The resistor R10 was replaced by a variable resistor R15 so that the reference voltage of the operation amplifier IC3 was changed to thereby change the brightness of the discharge lamp. In such a configuration, the experiments were carried out about the presence/absence of a jump and about the peak factor (peak value/effective value) of a high-frequency current flowing in the fluorescent lamp LA.

Table 1 shows the conditions and results of the experiments. In the experiments, in the feedback circuit FB, the resistor RS was set to 10 kΩ, the capacitor C8 was set to 1 nF, and the capacitor C2 was changed within a range of from 1 nF to 49 nF, so that the delay time T was established to be in a range of from 20 μs to 900 μs as shown in Table 1. The presence/absence of a jump and the current waveform diagram of the fluorescent lamp were inspected while the reference voltage of the operational amplifier IC3 was changed to be high (bright), medium (middle), and low (dark) correspondingly to the respective values of the delay time T, thereby checking whether the peak factor met a value not larger than 2.1 which is defined by JIS C8117 (fluorescent lamp electronic stabilizer).

In Table 1, the delay time T is expressed by (the resistance value of R10)×(the capacitance value of C8+the capacitance value of C2). In the columns of the reference voltage (brightness) of the operational amplifier IC3, ○ indicates there is no jump, X indicates presence of a jump, / indicates a peak factor, and the ratio in a pair of parenthesis indicates (peak value)/(effective value of the lamp current).

TABLE 1

| Exp. No. | Delay time T(μs) | Constants R5 (KΩ) | C8 (nF) | C2 (nF) | Lamp Current waveform diagram |
|---|---|---|---|---|---|
| 1 | 20 | 10 | 1 | 1 | FIG. 2 |
| 2 | 30 | 10 | 1 | 2 | FIG. 3 |
| 3 | 70 | 10 | 1 | 6 | FIG. 4 |
| 4 | 100 | 10 | 1 | 9 | FIG. 5 |
| 5 | 120 | 10 | 1 | 11 | FIG. 6 |
| 6 | 400 | 10 | 1 | 39 | FIG. 7 |
| 7 | 500 | 10 | 1 | 49 | FIG. 8 |
| 8 | 900 | 9.1 | 100 | 1.22 | FIG. 8 |

| Exp. No. | Reference voltage VR (Brightness) High (bright) Lamp current waveform diagram (a) | Medium (middle) Lamp current waveform diagram (b) | Low (dark) Lamp current waveform diagram (c) | Judgement Jump | Peak Factor |
|---|---|---|---|---|---|
| 1 | ○/1.4 (0.54/0.38) | ○/1.4 (0.35/0.25) | ○/1.4 (0.21/0.15) | OK | OK |
| 2 | ○/1.4 (0.54/0.38) | ○/1.6 (0.35/0.21) | ○/1.5 (0.21/0.14) | OK | OK |
| 3 | ○/1.4 (0.54/0.38) | ○/1.9 (0.35/0.18) | ○/1.8 (0.21/0.12) | OK | OK |
| 4 | ○/1.4 (0.54/0.38) | ○/2.1 (0.35/0.18) | ○/2.0 (0.21/0.10) | OK | OK |
| 5 | ○/1.4 (0.54/0.38) | ○/2.4 (0.35/0.15) | ○/2.1 (0.21/0.10) | OK | NG |
| 6 | ○/1.4 (0.54/0.38) | ○/2.7 (0.35/0.13) | ○/2.4 (0.21/0.09) | OK | NG |
| 7 | ○/1.4 (0.54/0.38) | X/1.4(0.25) (0.35/0.13) | X/1.4 (0.21/0.15) | NG | NG |
| 8 | ○/1.4 (0.54/0.38) | X/1.4 (0.21/0.15) | X/1.4 (0.21/0.15) | NG | NG |

Figure 1:
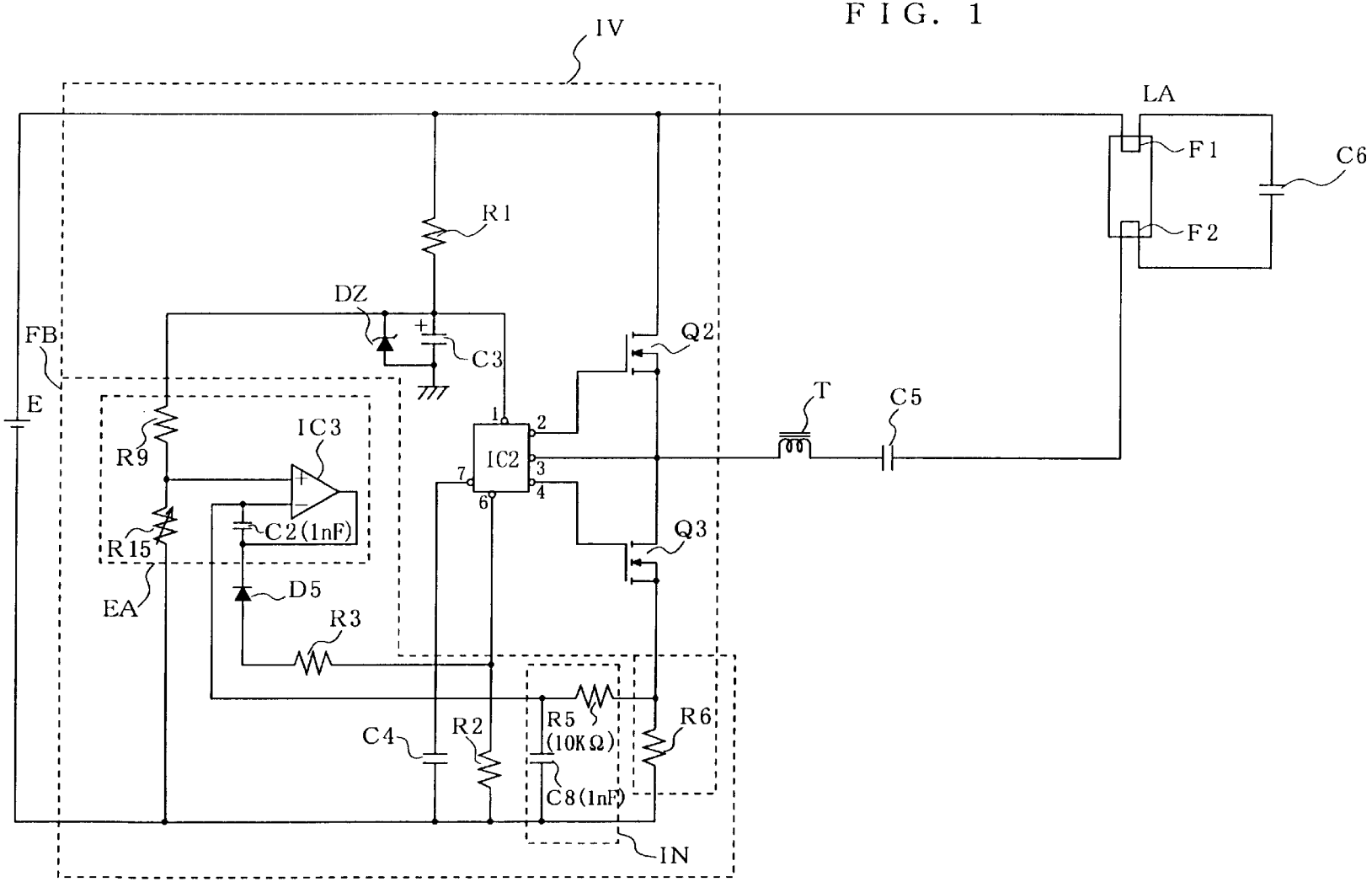
FIG. 1 is a circuit diagram of a discharge lamp lighting device showing Embodiment 1 of the present invention.

FIG. 1 is a circuit diagram of a discharge lamp lighting device in Experiment 1 in Table 1. The resistor R10 in FIG. 12 showing a conventional example was replaced by a variable resistor R15, and the constants determining the delay time T of the feedback circuit FB were changed so that the resistor R5 was 10 kΩ, the capacitor C8 was 1 nF, and the capacitor C2 was 1 nF. The other configuration was the same as that in FIG. 12 and therefore the description of the configuration will be omitted here.

FIGS. 2, 3, 4, 5, 6 and 7 are fluorescent lamp current waveform diagrams when the delay time T was selected to be 20 μs, 30 μs, 70 μs, 100 μs, 120 μs, 400 μs, respectively. FIG. 8 is the similar diagram when T was 500 μs and 900 μs.

The diagrams (a), (b) and (c) in each of FIGS. 2 to 8 designate the cases where the reference voltage of the operational amplifier IC3 was high (bright), medium (middle) and low (dark) respectively. As for the fluorescent lamp, a 40 W lamp used generally was used. The reference voltage was set to 1.8 V as a large value, 1.2 V as a medium value, and 0.8 V as a small value. In addition, the peak values A1, A2 and A3 of the lamp current shown in the drawings were 0.54 A, 0.35 A and 0.21 A, respectively.

The frequency became higher as the reference voltage became lower. In addition, when the amplitude changed in an envelope waveform diagram of the lamp current, the frequency got higher at the place where the amplitude was large.

Figure 2:
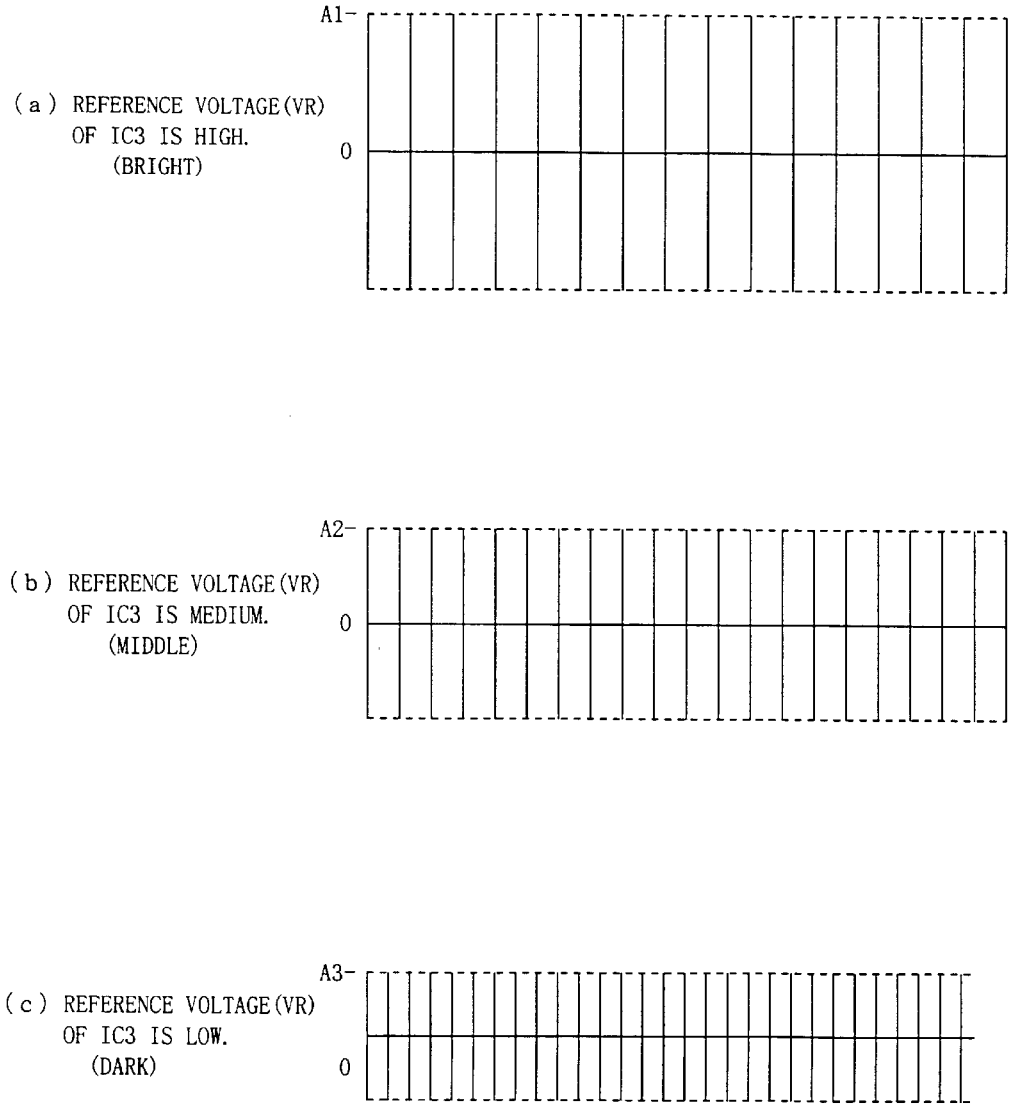
FIGS. 2(*a–c*) is a discharge lamp current waveform diagram of the discharge lamp lighting device showing Embodiment 1 of the present invention.
Figure 14:
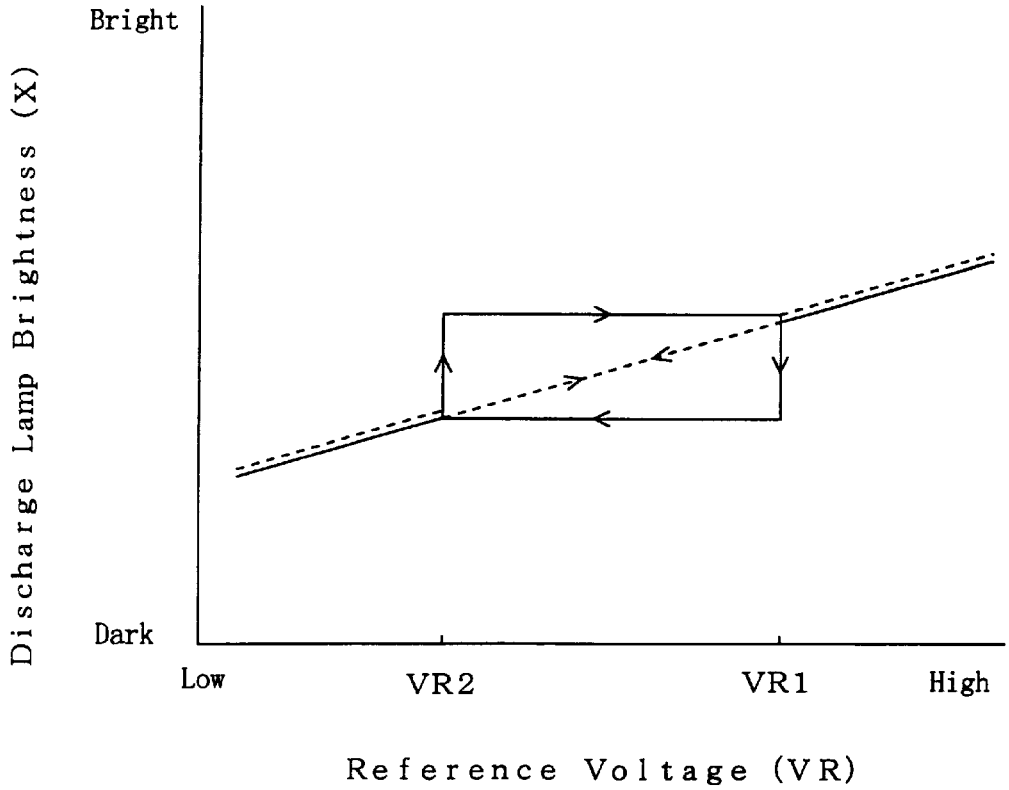
FIG. 14 BACKGROUND ART
FIG. 14 is a characteristic diagram showing the relationship between the reference voltage and the discharge lamp brightness in the conventional discharge lamp lighting device contrasted to a desirable relationship.

When the delay time T was 20 μs, no jump appeared, and the peak factor was small to be 1.4, as shown in Table 1 and FIG. 2. In addition, the lamp current changed smoothly from A1 (0.54 A) to A3 (0.21 A) through A2 (0.35 A) in accordance with the change of the reference voltage of the operational amplifier IC3 from a large value to a small value, as shown by the dotted line in FIG. 14 of the conventional example.

Figure 3:
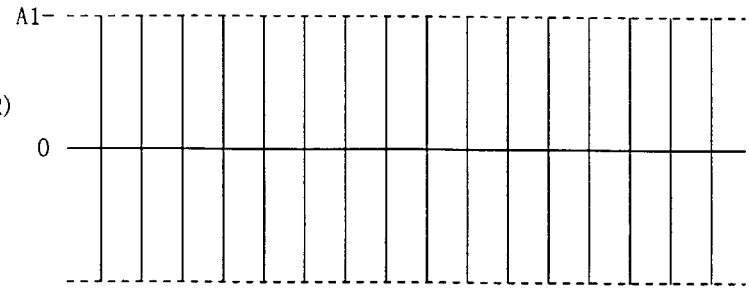
FIGS. 3(*a–c*) is a discharge lamp current waveform diagram of the discharge lamp lighting device showing Embodiment 1 of the present invention.
Figure 3:
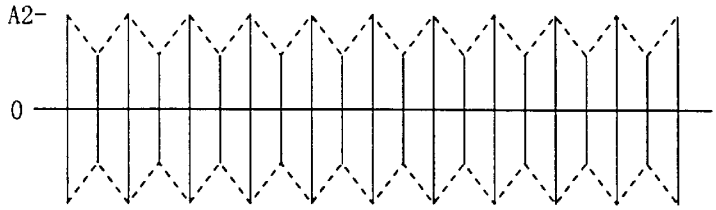
Figure 3:
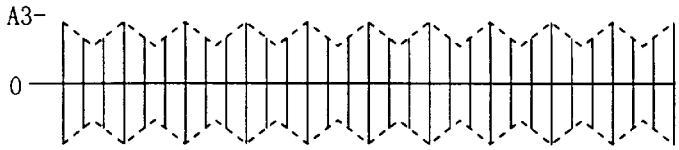
Figure 4:
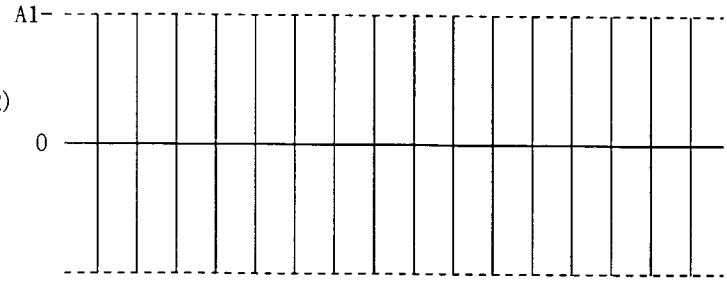
FIGS. 4(*a–c*) is a discharge lamp current waveform diagram of the discharge lamp lighting device showing Embodiment 1 of the present invention.
Figure 4:
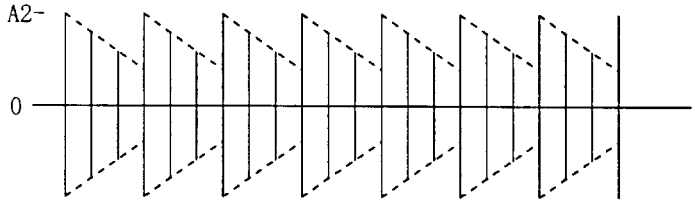
Figure 4:
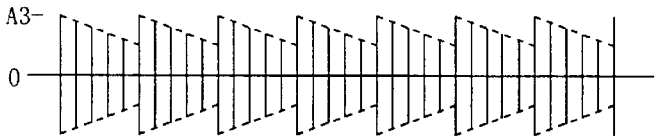
Figure 5:
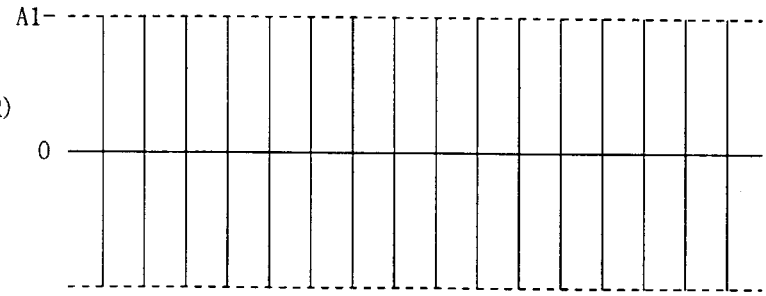
FIGS. 5(*a–c*) is a discharge lamp current waveform diagram of the discharge lamp lighting device showing Embodiment 1 of the present invention.
Figure 5:
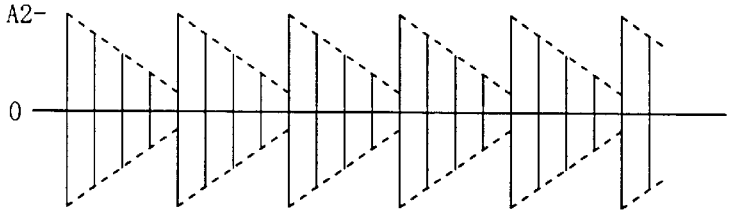
Figure 5:
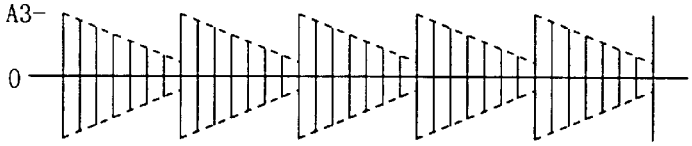
Figure 6:
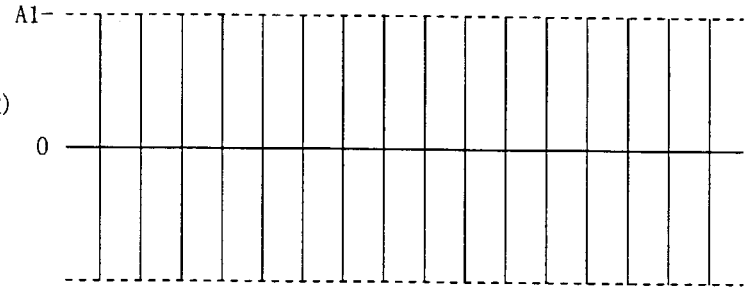
FIGS. 6(*a–c*) is a discharge lamp current waveform diagram of the discharge lamp lighting device showing Embodiment 1 of the present invention.
Figure 6:
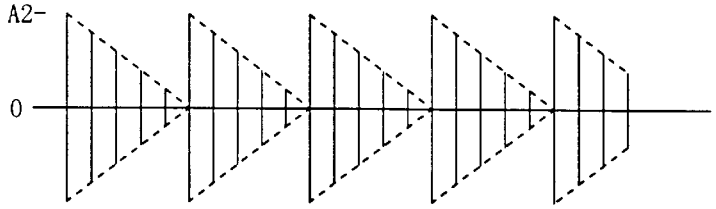
Figure 6:
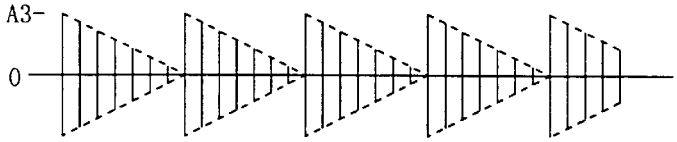

With the delay time T being prolonged to 30 μs and to 100 μs, the peak factor increased when the reference voltage of the operational amplifier IC3 was medium or low, though no jump appeared and the lamp current changed smoothly from A1 to A3 through A2 as shown in FIGS. 3 to 5. At 120 μs, no jump appeared, but the peak factor was 2.4 beyond 2.1 when the reference voltage was medium (middle brightness) as shown in FIG. 6(*b*).

Figure 7:
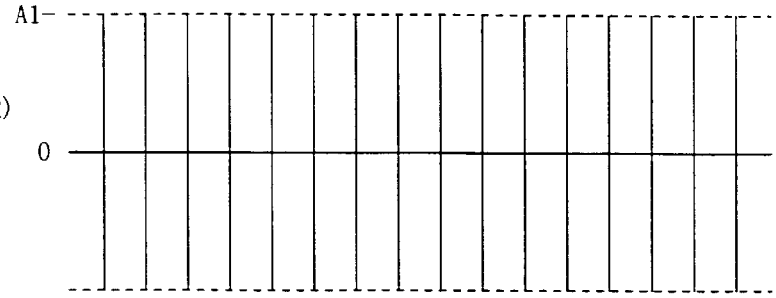
FIGS. 7(*a–c*) is a discharge lamp current waveform diagram of the discharge lamp lighting device showing Embodiment 1 of the present invention.
Figure 7:
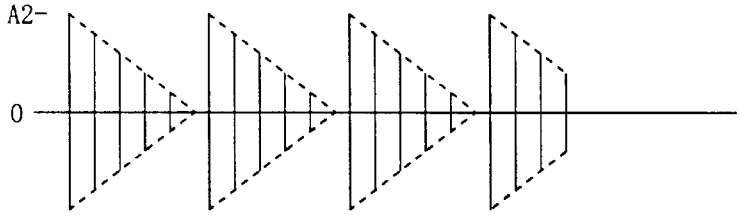
Figure 7:
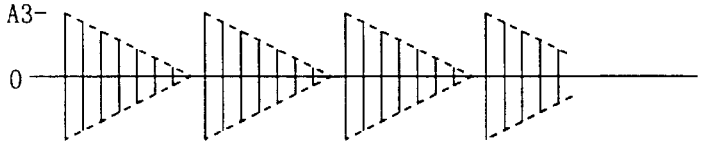
Figure 8:
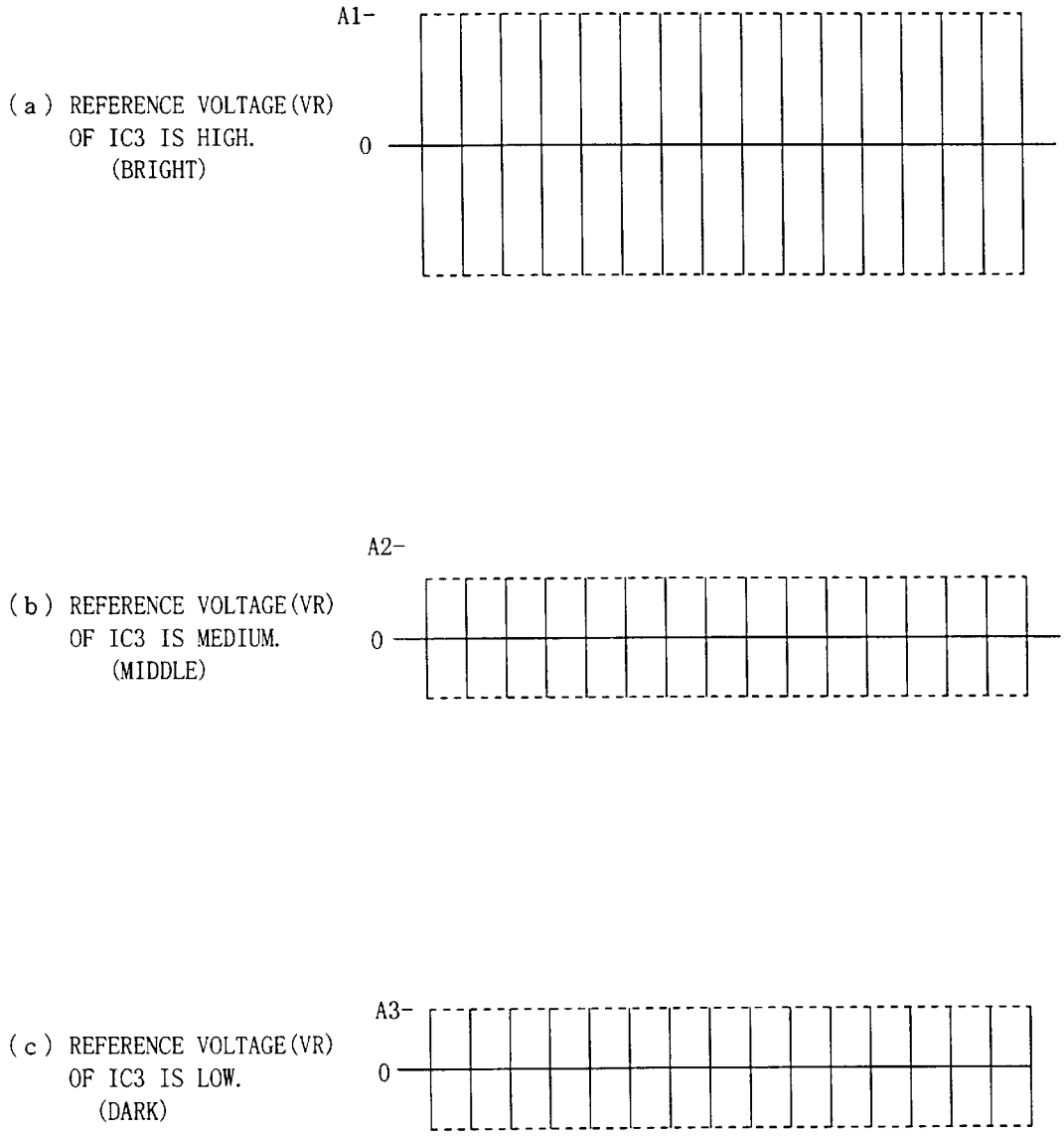
FIGS. 8(*a–c*) is a discharge lamp current waveform diagram of the discharge lamp lighting device showing Embodiment 1 of the present invention.

Further, with the delay time T being prolonged to 400 μs, no jump appeared, but there arose an idle period in the lamp current when the reference voltage was medium or low as shown in FIGS. 7(*b*) and (*c*), and the peak factor exceeded 2.1 in either case.

At 500 μs, a jump was produced. The peak factor at that time was low to be 1.4, but the peak value of the lamp current was reduced suddenly from A1 to A3 through A2, showing the fact that a jump was produced as shown in FIG. 8(*b*).

Further, at 900 μs which was a delay time T in the conventional example, things were the same as those at 500 μs in FIG. 8, and a jump arose though the peak factor was low to be 1.4.

The reason why the peak factor was low to be 1.4 at the medium or low reference voltage when the delay time T was long to be 500 μs or 900 μs, is that the lamp power was reduced suddenly with a sudden reduction of the lamp current caused by a jump, so that the frequency reached its control limit though the feedback circuit FB attempted to reduce the frequency to thereby recover the lamp current, and the frequency became constant at a minimum. At that time, the impedance of the fluorescent lamp LA took a value ten times as large as before the jump.

From Table 1, when the reference voltage was high, no jump was produced and the peak factor was also low to be 1.4, even if the delay time T was long.

This is because no jump was produced because the lamp had one operating point in a range where the lamp current is large.

From the above result, it has been found that it is necessary to make the delay time T be 100 μs (=1/10,000 s)

or less in order to establish both avoiding a jump phenomenon and making the peak factor be 2.1 or less at the same time.

If the peak factor is permitted to exceed 2.1 while a jump phenomenon is merely avoided, it can be said that it is only necessary to make the delay time T be 400 $\mu$s (=1/2,000 s) or less.

To avoid a jump phenomenon in such a manner, the reliability is high so long as the delay time T is 1/10,000 s (100 $\mu$s) or less if the scattering of the fluorescent lamp and environmental temperature in practical use are taken into consideration. However, to keep the lamp power in a predetermined constant value, it is necessary to set a lower limit of the delay time T to be one or more cycles of the oscillation frequency of the inverter circuit IV. This is because the average power cannot be judged on principle if the delay time T is under one cycle of the oscillation frequency of the inverter circuit IV.

As has been described above, in order to establish both avoiding a jump phenomenon and making the peak factor be 2.1 or less at the same time, it is merely necessary to satisfy the condition $1/f \leqq T \leqq 1/10{,}000$ where f represents the frequency, and T represents the delay time (sec).

Next, description will be made about the operation of the discharge lamp lighting device shown in FIG. 1. FIG. 1 shows a discharge lamp lighting device using the circuit constants shown in Experiment NO. 1 of Table 1. That is, the resistor R5 of the feedback circuit FB is 10 KΩ, the capacitor C8 is 1 nF, the capacitor C2 is 1 nF, and the delay time T is T=10 KΩ×(1 nF+1 nF)=20 $\mu$s.

The operation till the discharge lamp LA is lighted is the same as that in the conventional example, and the description will be omitted here.

The operation when dim control LA is performed by means of the variable resistor R15 will be explained. First, in a first light reduction operation cycle, the reference voltage VR of the operational amplifier IC3 is made lower (light reduction operation) by reducing the variable resistor R15 when the input terminal voltage error of the operational amplifier IC3 is 0. Then, the positive terminal voltage of the operational amplifier IC3 becomes low (error production); hence the output voltage of the operational amplifier IC3 becomes low; hence the current of the resistor R20 becomes large; hence the frequency f becomes high; hence the current of the discharge lamp becomes small; hence the power of the discharge lamp LA becomes small; hence the average current of the resistor R29 becomes small; and hence the output voltage of the integrating circuit IN (the negative terminal voltage of the operational amplifier IC3) becomes low. Therefore, no jump is produced.

Next, in a second light reduction operation cycle, the variable resistor R15 is further reduced (light reduction operation) when the input terminal voltage error of the operational amplifier IC3 is 0. Then, the positive terminal voltage of the operational amplifier IC3 becomes low (error production); hence the output voltage of the operational amplifier IC3 becomes low; hence the current of the resistor R20 becomes large; hence the frequency f becomes high; hence the current of the discharge lamp LA becomes small; hence the power of the discharge lamp LA becomes small; hence the average current of the resistor R29 becomes small; and hence the output voltage of the integrating circuit IN (the negative terminal voltage of the operational amplifier IC3) becomes low. Therefore, no jump is produced.

Figure 15:
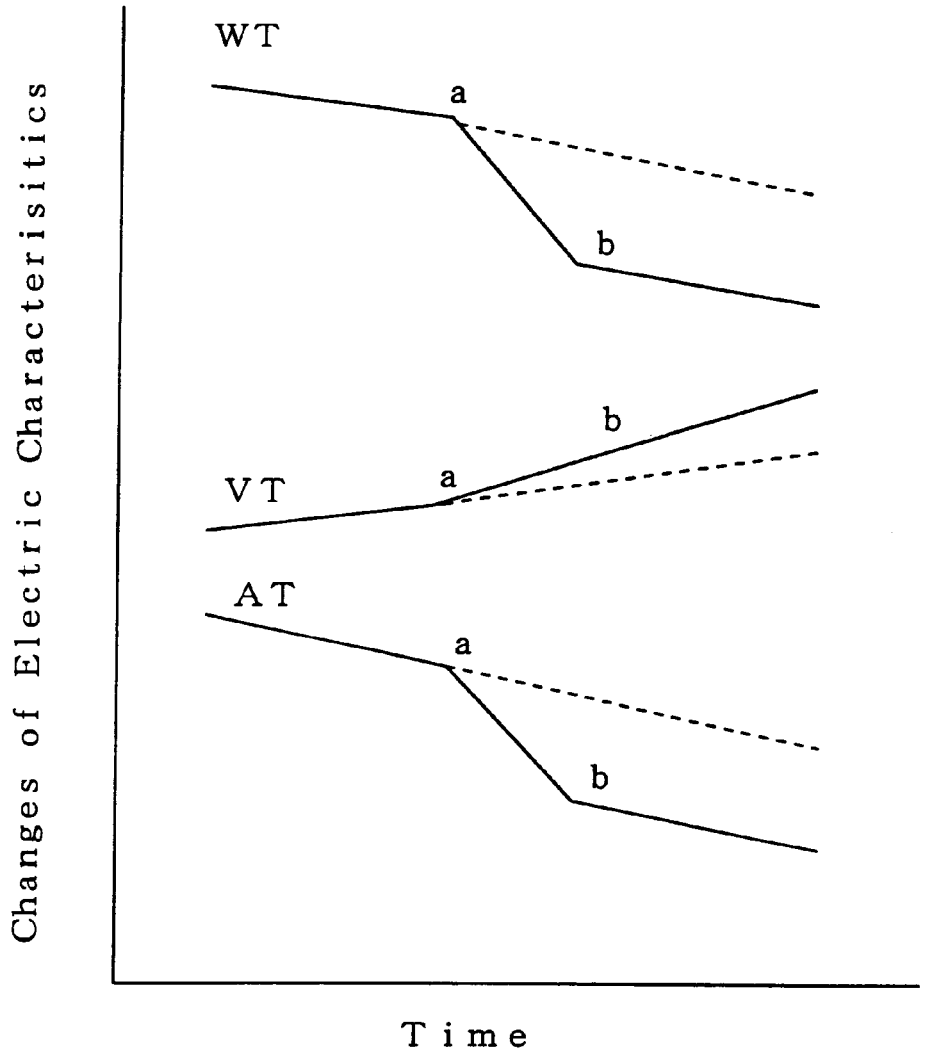
FIG. 15 BACKGROUND ART
FIG. 15 is a graph showing changes of electric characteristics of a discharge lamp in the conventional discharge lamp lighting device contrasted to those of an embodiment of the present invention.

In such a manner, even if the reference voltage is changed, there occurs no jump in which brightness largely changes as shown by the dotted line in FIG. 15 which is a conventional example. This is because the delay time T, which is 20 $\mu$s, is a short period corresponding to one cycle of lighting frequency if it is assumed that the lighting frequency is, for example, 50 kHz, and the constant load power keeping function of the feedback circuit FB makes a response. Then, the waveform of the lamp current is shown in FIG. 2 as mentioned above, and the peak factor is 1.4.

In the conventional example, in the case of such a light reduction operation, in the above-mentioned second light reduction operation cycle, the output voltage of the operational amplifier IC3 becomes low; hence the current of the resistor R20 becomes large; hence the frequency f becomes high; after that, the power of the discharge lamp LA becomes extremely small; hence the average current of the resistor R29 becomes extremely small; and hence the output voltage of the integrating circuit IN (the negative terminal voltage of the operational amplifier IC3) becomes extremely low. Therefore, a jump is produced. At that time, because the input terminal voltage error of the operational amplifier IC3 is not 0 so that an error continues to appear. Accordingly, control is made so that the output voltage of the operational amplifier IC3 is high; the current of the resistor R20 is small; and the frequency f is low. However, the control of the feedback circuit FB reaches a limit, so that the frequency f is fixed at a minimum value MIN.

As has been described above, in Embodiment 1, it is possible to perform dim control for a discharge lamp continuously and stably over a wide range, with a simple circuit configuration and at a low price.

Embodiment 2

Figure 9:
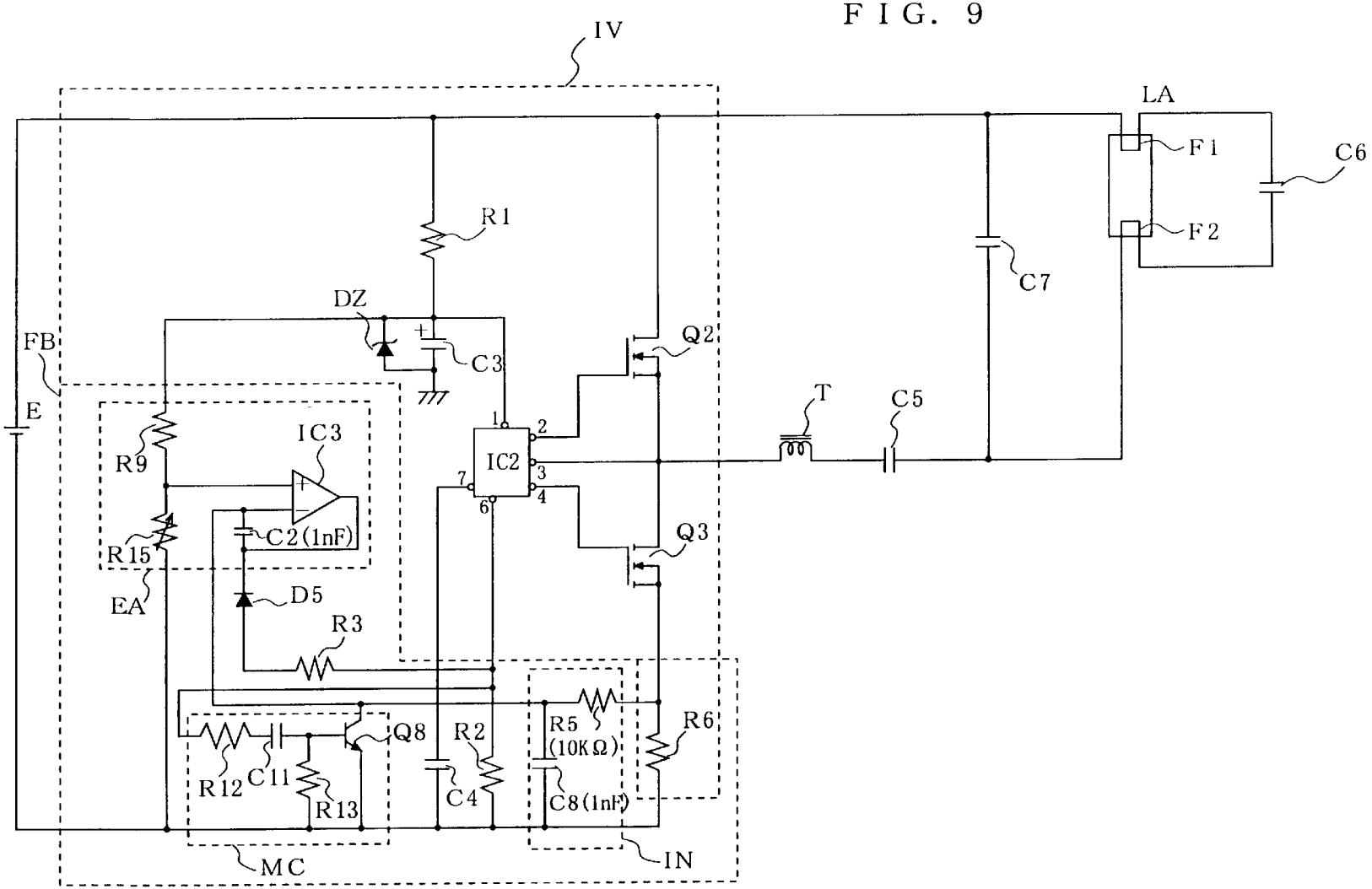
FIG. 9 is a circuit diagram of a discharge lamp lighting device showing Embodiment 2 of the present invention.

FIG. 9 is a circuit diagram of a discharge lamp lighting device showing Embodiment 2. In this embodiment, a mask circuit MC for controlling the feedback circuit FB is provided in the output of the integrating circuit IN in FIG. 1 showing Embodiment 1.

In FIG. 9, parts the same as or corresponding to those in Embodiment 1 shown in FIG. 1 are referenced correspondingly, and duplicated description will be omitted here. The mask circuit MC is constituted by: a transistor Q8 the collector of which is connected to the output portion of the integrating circuit IN, and the emitter of which is connected to the negative pole of the power supply E; a capacitor C11 connected between the current output terminal 6 of the IV control integrated circuit IC2 and the base of the transistor Q8 through a resistor R12; and a resistor R13 connected between the base and the emitter of the transistor Q8. The capacitor C11 and the resistor R13 constitute a timer.

Figure 10:
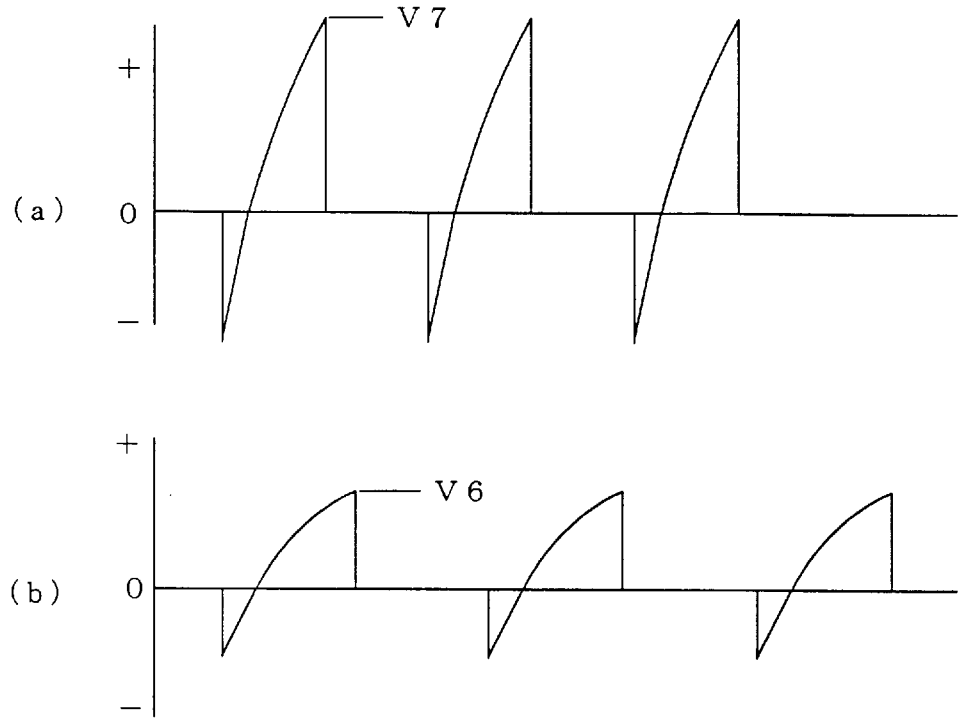
FIGS. 10(*a–b*) is a high-frequency voltage waveform diagram of the discharge lamp lighting device showing Embodiment 2 of the present invention.

Next, the operation will be described with reference to FIGS. 9 and 10. As mentioned in the conventional example, the high-frequency voltage of the starting capacitor C6 generated by the LC resonance of the ballast choke T and the capacitor C6 is applied to the discharge lamp LA, so that the discharge lamp LA is lighted. Assume now that immediately before the discharge lamp LA is lighted, a high-frequency voltage shown in FIG. 10(*a*) is generated in the detection resistor R6, and a peak value V7 of this voltage is going to be larger than a peak value V6 when the lamp is lighted in FIG. 10(*b*). Then, in Embodiment 1, particularly when the reference voltage of the operational amplifier IC3 is set to a comparatively low value, the feedback circuit FB makes a response so quickly that the constant load power keeping function of the feedback circuit FB operates before the peak value of the high-frequency voltage of the detection resistor R6 reaches the value V7. Therefore, there is a high possibility that the high-frequency voltage of the detection resistor R6 is kept in a low value by the constant load power keeping function. As a result, there is a case where the resonance necessary for lighting the discharge lamp LA does not reach so that the discharge lamp LA can not be lighted.

At that time, the mask circuit MC short-circuits the output of the integrating circuit IN for an enough time (for example, 2 to 4 seconds) to light the discharge lamp LA since the power supply E is turned on to thereby prevent the output of the integrating circuit IN from reaching the reference voltage of the operational amplifier IC3 before lighting. In such a manner, the oscillation frequency of the IV control integrated circuit IC2 is prevented from being fixed.

That is, when the power supply E is turned on, an electric current flows, in a closed loop, from the control power capacitor C3, to the current output terminal 6 of the IV control integrated circuit IC2, to the resistor R12, to the capacitor C11, to the base to emitter of the transistor Q8, and to the control power capacitor C3. As a result, the transistor Q8 is turned ON, and the capacitor C11 is charged.

Then, this closed loop current is reduced gradually, so that the oscillation frequency of the IV control integrated circuit IC2 becomes low, and the output of the integrating circuit IN, that is, the resonance voltage of the capacitor C8 becomes high to thereby light the discharge lamp LA. When the capacitor C11 is charged up, the transistor Q8 is turned OFF to release the mask function of the mask circuit MC. The charge of the capacitor C11 may be fed from the control capacitor C3 directly.

As has been described, in this Embodiment 2, it is possible to light a discharge lamp surely.

Embodiment 3

Figure 11:
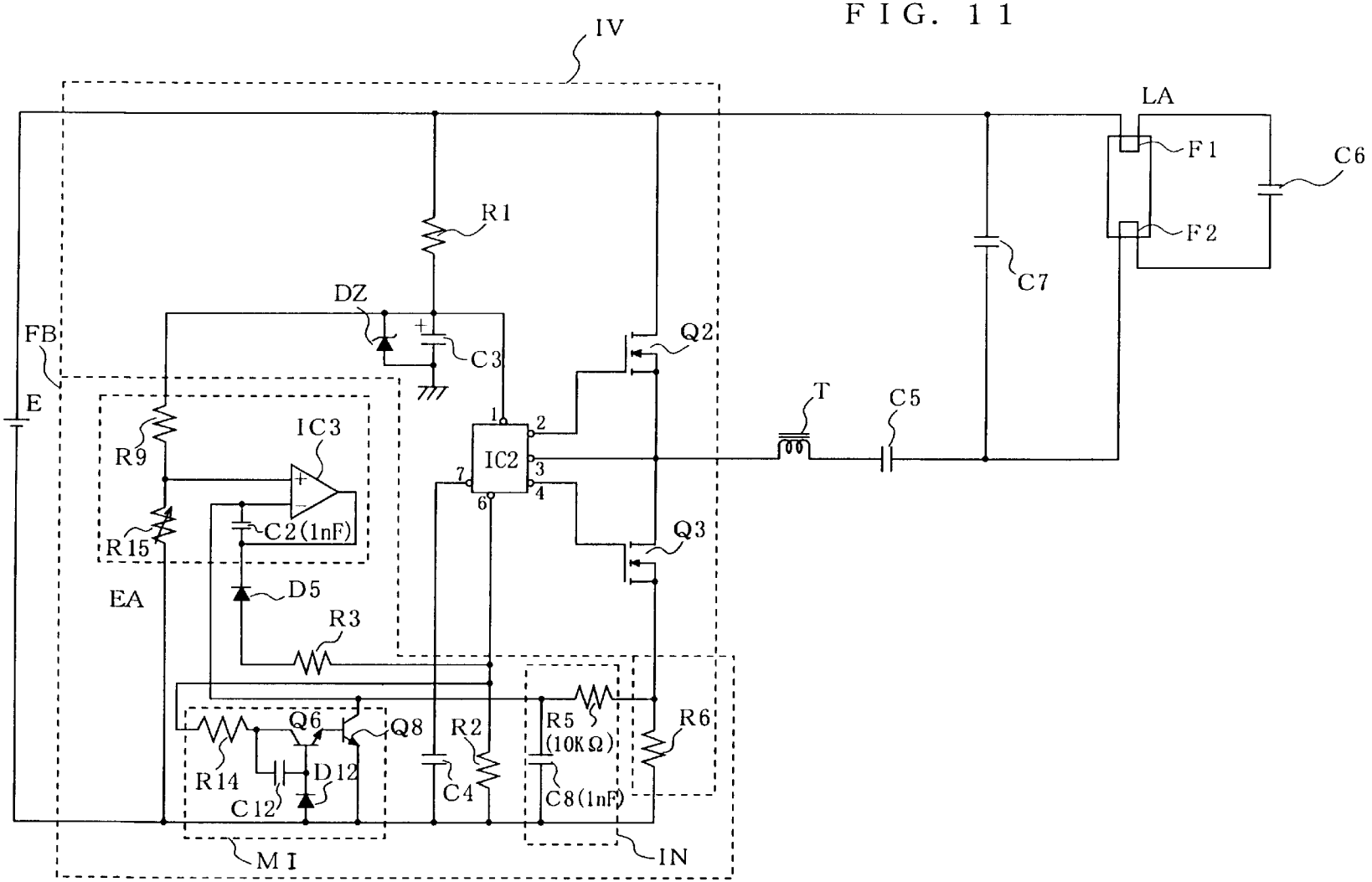
FIG. 11 is a circuit diagram of a discharge lamp lighting device showing Embodiment 3 of the present invention.

FIG. 11 is a circuit diagram of a discharge lamp lighting device showing Embodiment 3. In this embodiment, the mask circuit MC described in Embodiment 2 is replaced by a mirror integrating circuit MI for controlling the feedback circuit FB.

In FIG. 11, parts the same as or corresponding to those in FIG. 9 shown in Embodiment 2 are referenced correspondingly, and duplicated description will be omitted here. The mirror integrating circuit MI is constituted by: a transistor Q8 the collector of which is connected to the output portion of the integrating circuit IN, and the emitter of which is connected to the negative pole of the power supply E; a transistor Q6 the emitter of which is connected to the base of the transistor Q8, and the collector of which is connected to the current output terminal 6 of the IV control integrated circuit IC2 through a resistor R14; a diode D12 connected between the base of the transistor Q6 and the negative pole of the power supply E; and a capacitor C12 connected between the base and the emitter of the transistor Q6.

Next, the operation will be described with reference to FIG. 11. The mirror integrating circuit MI has the same function as the mask circuit MC. However, when the power supply E is turned on, an electric current flows, in a closed loop, from the control power capacitor C3, to the current output terminal 6 of the IV control integrated circuit IC2, to the resistor R14, to the capacitor C12, to the base to emitter of the transistor Q6, to the base to emitter of the transistor Q8, and to the control power capacitor C3. As a result, the transistor Q8 is turned ON, and the capacitor C12 is charged. When this ON time of the transistor Q8 is set to the same value as that in Embodiment 2, the capacitance value of the capacitor C12 can be reduced to 1/(the DC current amplification factor ($h_{FE}$) of the transistor Q6) of the capacitance value of the capacitor C11 in comparison with Embodiment 2. Therefore, if a transistor having a DC current amplification factor of some hundreds is used as the transistor Q6, the capacitance value of the capacitor C12 can be made to be one to some hundreds of the capacitance value of the capacitor C11. Thus, the capacitance value of the capacitor C12 can be made so small that it is possible to extremely shorten the time for the capacitor C12 to discharge, in a closed loop, from the capacitor C12 to the resistor R14, to the resistor R2, to thediode D12, and to the capacitor C12 when the power supply E is turned OFF.

As has been described, the time for the capacitor C12 to discharge can be extremely shorten so that the mirror integrating circuit MI can be reset surely in response to the ON/OFF operation of the power supply E performed in a short time. Accordingly, it is possible to light a discharge lamp more surely.

We claim:

1. A discharge lamp lighting device comprising:

an inverter control integrated circuit configured to provide an oscillation output signal;

an inverter including on/off switching elements configured to respond to the oscillation output signal to invert a DC voltage from a DC power supply into high-frequency electric power;

a discharge lamp connected to receive said high-frequency electric power from said inverter and to provide a corresponding light output; and a feedback circuit having delayed time T expressed by $1/f \leqq T \leqq 1/2{,}000$ with the frequency of said high-frequency electric power being f, said feedback circuit including a reference value setting circuit configured to set a reference value, said feedback circuit being configured to output a voltage for controlling said inverter control integrated circuit to control said high-frequency electric power according to said reference value to thereby perform dimming control of said discharge lamp light output.

2. A discharge lamp lighting device comprising:

an inverter control integrated circuit configured to provide an oscillation output signal;

an inverter including on/off switching elements configured to respond to the oscillation output signal to invert a DC voltage from a DC power supply into high-frequency electric power;

a discharge lamp connected to receive said high-frequency electric power from said inverter and to provide a corresponding light output; and a feedback circuit having a delay time T expressed by $1/f \leqq T \leqq 1/10{,}000$ with the frequency of said high-frequency electric power being f, said feedback circuit including a reference value setting circuit configured to set a reference value, said feedback circuit being configured to output a voltage for controlling said inverter control integrated circuit to control said high-frequency power according to said reference voltage to thereby perform dimming control of said discharge lamp light output.

3. The discharge lamp lighting device according to claim 2, further comprising a feedback control circuit connected to an output portion of an integrating circuit provided in said feedback circuit, said feedback control circuit being driven by an electric current fed from a main oscillation resistor connection terminal for determining the oscillation frequency of said inverter control integrated circuit wherein said feedback control circuit makes said feedback circuit inoperative for a predetermined time required for lighting said discharge lamp when said DC power supply is turned on.

4. The discharge lamp lighting device according to claim 3, wherein said feedback control circuit is a mask circuit which includes:

a timer constituted by a capacitor and a resistor configured to output an inputted electric current for a predetermined time; and a transistor configured to be driven by said electric current fed from said timer and to short-circuit the output of said integrating circuit for the predetermined time.

5. The discharge lamp lighting device according to claim 3, wherein said feedback control circuit is a mirror integrating circuit which includes:

a timer having a capacitor and a resistor configured to output an inputted electric current for a predetermined time;

a first transistor configured to be driven by said electric current fed from said timer; and a second transistor configured to be driven in response to driving said first transistor to short-circuit the output of said integrating circuit for the predetermined time.

* * * * *